US008968168B2

(12) United States Patent
Takeuchi et al.

(10) Patent No.: US 8,968,168 B2
(45) **Date of Patent: *Mar. 3, 2015**

(54) ELECTRICALLY CONDUCTIVE ROLLER AND IMAGE-FORMING DEVICE

(75) Inventors: Tomoharu Takeuchi, Saitama (JP); Hiroyuki Takanashi, Saitama (JP); Taichi Ohkubo, Saitama (JP)

(73) Assignee: Shin-Etsu Polymer Co., Ltd., Tokyo (JP)

( * ) Notice: Subject to any disclaimer, the term of this patent is extended or adjusted under 35 U.S.C. 154(b) by 380 days.

This patent is subject to a terminal disclaimer.

(21) Appl. No.: 13/388,398

(22) PCT Filed: Aug. 21, 2009

(86) PCT No.: PCT/JP2009/004045

§ 371 (c)(1),
(2), (4) Date: Feb. 1, 2012

(87) PCT Pub. No.: WO2011/016099

PCT Pub. Date: Feb. 10, 2011

(65) Prior Publication Data

US 2012/0134714 A1 May 31, 2012

(30) Foreign Application Priority Data

Aug. 5, 2009 (JP) ..... 2009-182472

(51) Int. Cl.
*G03G 15/16* (2006.01)
*G03G 15/02* (2006.01)
(Continued)

(52) U.S. Cl.
CPC ..... *G03G 15/0233* (2013.01); *G03G 15/0818* (2013.01); *G03G 15/1685* (2013.01); *G03G 15/2057* (2013.01)
USPC ..... 492/56; 492/59; 399/176

(58) Field of Classification Search
USPC ..... 492/53, 56, 47, 59; 399/176
See application file for complete search history.

(56) References Cited

U.S. PATENT DOCUMENTS 4,505,573 A * 3/1985 Brewington et al. ..... 399/284
4,551,894 A * 11/1985 Beucker ..... 492/31

(Continued)

FOREIGN PATENT DOCUMENTS

JP 2003202722 A 7/2003
JP 2004191655 A 7/2004

(Continued)

OTHER PUBLICATIONS

English translation of JP 2004331885 A obtained from espace.net on Mar. 12, 2014.*

(Continued)

*Primary Examiner* — David Bryant
*Assistant Examiner* — Jason L Vaughan
(74) *Attorney, Agent, or Firm* — The Webb Law Firm

(57) ABSTRACT

This invention provides an electrically conductive roller capable of forming an image without fogging even in a low humidity environment and an image-forming device. Specifically, the invention relates to an electrically conductive roller has an elastic layer formed on an outer circumferential surface of a shaft and a urethane coat layer formed on an outer circumferential surface of the elastic layer, wherein the urethane coat layer includes a urethane resin, and at least one ionic liquid selected from the group consisting of pyridinium ionic liquids and amine ionic liquids, in an amount from 1 to 20 parts by mass to 100 parts by mass of the urethane resin; and an image-forming device equipped with the electrically conductive roller.

15 Claims, 2 Drawing Sheets

(51) Int. Cl.
*G03G 15/08* (2006.01)
*G03G 15/20* (2006.01)

(56) References Cited

U.S. PATENT DOCUMENTS

| | | | | |
|---|---|---|---|---|
| 5,768,668 | A * | 6/1998 | Shiraki et al. | 399/281 |
| 6,004,669 | A * | 12/1999 | Rokutan et al. | 428/335 |
| 6,360,069 | B1 * | 3/2002 | Mimura et al. | 399/286 |
| 6,810,227 | B2 * | 10/2004 | Sakata et al. | 399/281 |
| 6,952,550 | B2 * | 10/2005 | Ohkuwa et al. | 399/281 |
| 7,288,058 | B2 * | 10/2007 | Kaji et al. | 492/59 |
| 7,291,399 | B2 * | 11/2007 | Kaplan et al. | 428/447 |
| 7,505,720 | B2 * | 3/2009 | Sugama et al. | 399/286 |
| 8,337,373 | B2 * | 12/2012 | Sakata | 492/56 |
| 2007/0037680 | A1 * | 2/2007 | Tagawa et al. | 492/56 |
| 2007/0197362 | A1 * | 8/2007 | Sakata et al. | 492/49 |
| 2008/0146427 | A1 * | 6/2008 | Osaku | 492/56 |
| 2012/0025143 | A1 * | 2/2012 | Takeyama et al. | 252/500 |
| 2013/0281275 | A1 * | 10/2013 | Nishioka et al. | 492/18 |

FOREIGN PATENT DOCUMENTS

| | | | |
|---|---|---|---|
| JP | 2004331885 | A * | 11/2004 |
| JP | 2005220317 | A | 8/2005 |
| JP | 2006193704 | A | 7/2006 |
| JP | 2008276022 | A | 11/2008 |
| JP | 2011053658 | A * | 3/2011 |
| JP | 2011221442 | A * | 11/2011 |

OTHER PUBLICATIONS

English translation of JP 20030718 A, human translation obtained from STIC translations on Mar. 27, 2014.*

* cited by examiner

ELECTRICALLY CONDUCTIVE ROLLER AND IMAGE-FORMING DEVICE

TECHNICAL FIELD

The present invention relates to an electrically conductive roller and an image-forming device. More specifically, the present invention relates to an electrically conductive roller capable of forming an image without fogging even in a low humidity environment and an image-forming device equipped with the roller.

BACKGROUND ART

Printers such as laser printers and video printers, copying machines, facsimile machines and all-in-one printers with the functions of these printers and machines employ various image-forming devices utilizing electrophotography. Electrophotographic image-forming devices are equipped with various rollers. Examples of such rollers may include conductive rollers with electric conductivity or semiconductivity, and elastic rollers with a relatively low hardness. The electrically conductive rollers may include, for example, charge rollers for uniformly charging image carriers such as photoreceptors, developing rollers for carrying and conveying a toner to supply the toner to image carriers, toner-supplying rollers for supplying a toner to a developing roller while charging the toner, and fixing rollers for fixing a toner that has been transferred to a recording material, such as recording paper, to the material. These various rollers are usually different in their properties such as hardness and electric resistivity, depending on the function and/or uses of each roller.

For Example, Patent document 1 discloses "an electrically semiconductive member that includes an ionic liquid" for such electrically conductive rollers. Specifically, it teaches "a charge roller that includes a salt of methylimidazolium, and a vinyl monomer or a (meth)acrylate" in a working example.

Also, Patent document 2 teaches "an electrically conductive member for electrophotographic instruments including an electrically conductive composition for electrophotographic instruments, for at least a part of the electrically conductive member, which requires components (A)-(C), wherein the components are:

(A) a matrix polymer, (B) at least one electrically conductive filler selected from the group consisting of a metal oxide, a metal carbide, and carbon black with a DBP adsorption of 100 mL/g or more, and (C) an ionic liquid.

Patent document 2 specifically discloses a developing roll having a base layer including silicone polymer and 1-hexyl-3-methylimidazoliumtrifluoromethane sulfonate in Working Example 16.

When the conditions of the area surrounding the site on which an image-forming device is placed are changed, those of the inside of the device are changed accordingly. As a result, the properties of an electrically conductive roller installed in the device may sometimes be changed and the roller may not function sufficiently with originally designed performance.

For example, a developing roller, when the humidity surrounding it decreases, is not capable of supplying a toner with a predetermined amount of electrostatic charge to an image carrier, which causes a situation where unnecessary toner is fixed to a printed image such as a solid white print, which may also be called solid print. The unnecessary toner on the printed image is called fogging. This situation is remarkably experienced especially when a color image is printed after a monochrome image is printed. As explained hereinbefore, when the conditions of the area surrounding a roller installed in an image-forming device are changed, for example, the humidity around a developing roller is lowered, a desired image may not be obtained.

PRIOR ART DOCUMENTS

Patent Documents

Patent document 1: JP 2004-191655 A
Patent document 2: JP 2005-220317 A
Patent document 3: JP 2006-193704 A

SUMMARY OF THE INVENTION

Problems to be Solved by the Invention

The objective of the present invention is to provide an electrically conductive roller and an image-forming device capable of forming an image without fogging even in a low humidity environment.

Means to Solve the Problems

Assuming that fogging in a low humidity environment is caused by the amount of electrostatic charge of the toner that is supplied to the image carrier, the inventors of the present application intensively studied a static eliminating function that the developing roller has. As a result, they found that if the coat layer, especially a urethane coat layer, of the electrically conductive roller used as a developing roller included a predetermined amount of an ionic liquid, it would essentially prevent the occurrence of fogging even in a low humidity environment.

Based on this finding, the present invention, or the means for solving the aforementioned problem, provides an electrically conductive roller comprising an elastic layer formed on an outer circumferential surface of a shaft and a urethane coat layer formed on an outer circumferential surface of the elastic layer, wherein the urethane coat layer includes a urethane resin, and at least one ionic liquid selected from the group consisting of pyridinium ionic liquids and amine ionic liquids in an amount from 1 to 20 parts by mass to 100 parts by mass of the urethane resin.

The present invention, or the means for solving the aforementioned problem, provides an image-forming device equipped with the electrically conductive roller according to the present invention.

Advantages of the Invention

The electrically conductive roller according to the present invention has a urethane coat layer which includes a urethane resin, and at least one ionic liquid selected from the group consisting of pyridinium ionic liquids and amine ionic liquids in an amount from 1 to 20 parts by mass to 100 parts by mass of the urethane resin. As a result, the roller of the invention is capable of essentially preventing the occurrence of fogging in a low humidity environment as well as a normal humidity environment with, for example, about 50% relative humidity. The image-forming device of the present invention is equipped with an electrically conductive roller according to the present invention.

Therefore the present invention provides an electrically conductive roller and an image-forming device capable of forming an image without fogging even in a low humidity environment.

BEST MODE TO CARRYOUT THE INVENTION

Figure 1:
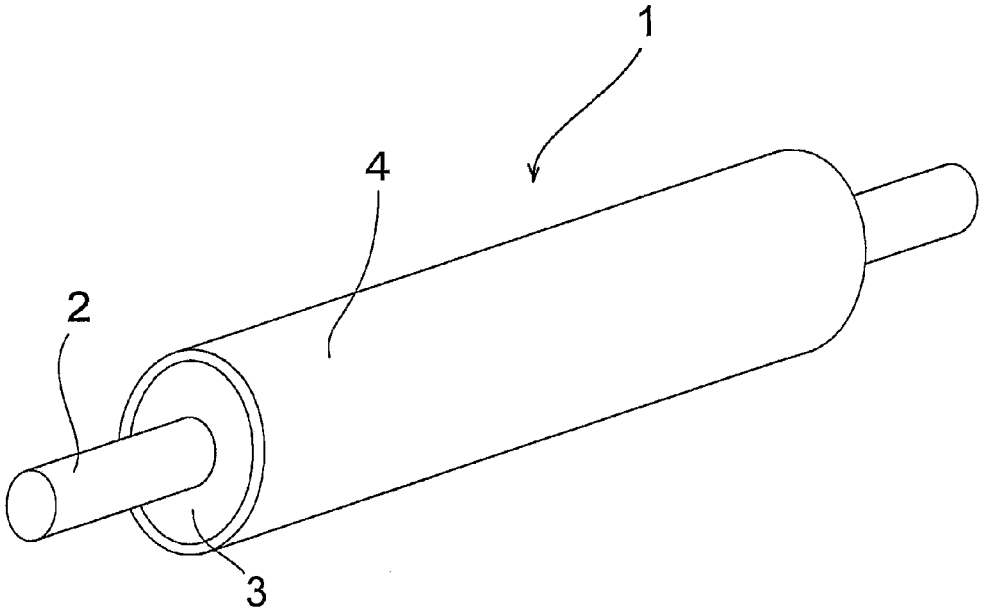
FIG. 1 is a perspective view showing an example of the electrically conductive roller according to the present invention.

The electrically conductive roller of the present invention comprises an elastic layer formed on an outer circumferential surface of a shaft and a urethane coat layer formed on an outer circumferential surface of the elastic layer, wherein the urethane coat layer includes at least one ionic liquid selected from the group consisting of pyridinium ionic liquids and amine ionic liquids, and a urethane resin, in a predetermined ratio. When the elastic layer is provided with the urethane coat layer including the aforementioned ionic liquid on the outer circumferential surface thereof, the objective of the present invention is achieved sufficiently, as stated above. In this invention, "low humidity environment" means an environment with a relative humidity of not more than 20%, preferably not more than 15% under which the objective of the present invention is remarkably achieved.

The electrically conductive roller of the present invention will be explained hereinafter with the aid of an example. An electrically conductive roller 1, which is an example of the present invention, is provided with a shaft 2, an elastic layer 3 and a urethane coat layer 4.

The shaft 2 is essentially the same as a shaft employed in conventionally known electrically conductive rollers. The shaft 2 is one which is known as "cored bar", made of metal such as iron, aluminum, stainless steel, or brass. The cored bar has excellent properties of electric conductivity. The shaft may have a core of an electrical insulator, such as thermoplastic resin or thermosetting resin, the core being metal plated so as to be electrically conductive.

The elastic layer 3 is essentially the same as an elastic layer employed in conventionally known electrically conductive rollers. An electrically conductive material, which will be explained hereafter, is cured on the outer circumferential surface of the shaft 2, and the elastic layer 3 is thus made. The elastic layer should preferably have a JIS A hardness of 20 to 70. The elastic layer with a JIS A hardness, or hardness according to JIS K6301, of 20 to 30, will be able to enlarge the contact area between the electrically conductive roller 1 and the thing being contacted. Also, the elastic layer is excellent in impact resilience and compression set.

The elastic layer 3 should preferably have a volume resistivity in the range of $10^1$ to $10^7$ Ω·cm, and/or an electrical resistivity in the range of $10^1$ to $10^9$Ω. When the volume resistivity and/or electrical resistivity of the elastic layer 3 is in the aforementioned range, it contributes to carrying and supplying a toner in a desired way and forming an image with a desired quality once the electrically conductive roller 1 is installed in an image-forming device. The volume resistivity may be measured with a method according to JIS K6911, with an applied volume of 100 V. The electrical resistivity may be measured with an ohmmeter, such as one whose product name is ULTRA HIGH RESISTANCE METER R8340A, manufactured by ADVANTEST CORPORATION, by the following method: The electrically conductive roller 1 is placed horizontally. As an electrode is used a gold-plated board-like member with a thickness of 5 mm, a width of 30 mm and a length sufficient to receive the entire length of the elastic layer 3 of the electrically conductive roller 1 on the member. With each end of the shaft 2 of the electrically conductive roller 1 loaded with 500 g, a voltage of DC 100 V is applied between the shaft 2 and the electrode. The value indicated by the ohmmeter one second after the application of the voltage is read, and the value is regarded as the electrical resistivity.

The elastic layer 3 preferably has a thickness of not less than 1 mm, because this thickness will ensure a uniform nip width between the urethane coat layer 4 and the thing being contacted when they contact each other. It will be more preferable if the elastic layer 3 has a thickness of not less than 5 mm. On the other hand, there is no limitation on the upper limit of the thickness as long as the accuracy of the outer diameter of a cylinder consisting of the shaft and the elastic layer 3 is not marred. However, when the thickness of the elastic layer 3 is increased too large, the cost of producing the elastic layer 3 is also increased. From the viewpoint of practical cost, the thickness of the elastic layer 3 should be preferably not more than 30 mm, more preferably not more than 20 mm. The thickness of the elastic layer 3 is properly decided depending on the hardness of the elastic layer 3, for example, according to JIS A hardness, so that the desired nip width will be achieved.

An electrically conductive composition of which the elastic layer 3 is made includes rubber, an electric conductivity-imparting agent, and optionally various additives. Examples of the rubber may include silicone or modified silicone rubber, nitrile rubber, ethylene propylene rubber including ethylene propylene diene rubber, styrene butadiene rubber, butadiene rubber, isoprene rubber, natural rubber, acrylic rubber, chloroprene rubber, butyl rubber, epichlorohydrin rubber, urethane rubber, and fluororubber. The rubber should preferably be made of silicone or modified silicone rubber, or urethane rubber, among them. Especially preferable are silicone rubber and modified silicone rubber, because they are excellent in heat resistance and charging characteristics. These rubbers may be liquid ones or milable ones. There is no special limitation on the electric conductivity-imparting agent, as long as it has electric conductivity. Examples of the agent may include electrically conductive powder of electrically conductive materials such as electrically conductive carbon, carbons for rubber, metal and electrically conductive polymer. The various additives may include, for example, auxiliaries such as chain extenders and crosslinking agents, catalysts, dispersants, foaming agents, age resistors, antioxidants, fillers, pigments, colorants, processing agents, softeners, plasticizers, emulsifiers, heat-resistance improvers, flame-retardant enhancers, acid acceptors, thermal conductivity improvers, mold release agents, solvents and the like.

Preferable examples of the electrically conductive composition may be addition-cure milable electrically conductive silicone rubber compositions and addition-cure liquid electrically conductive silicone rubber compositions. The addition-cure milable electrically conductive silicone rubber compositions include (A) an organopolysiloxane represented by average composition formula (1) shown below, (B) a filler and (C) an electrically conductive material other than those belonging to component (B).

$$R_nSiO_{(4-n)/2} \quad (1)$$

In this formula, R's, which may be the same or different from each other, each denote a substituted or unsubstituted hydrocarbyl group, preferably a substituted or unsubstituted hydrocarbyl group with 1-12 carbon atoms, more preferably a substituted or unsubstituted hydrocarbyl group with 1-8 carbon atoms; and n is a positive number from 1.95 to 2.05.

Examples of the substituent R may include an alkyl group such as methyl, ethyl, propyl, butyl, hexyl and dodecyl; a cycloalkyl group such as cyclohexyl; an alkenyl group such as vinyl, allyl, butenyl and hexenyl; an aryl group such as phenyl and tolyl; an aralkyl group such as β-phenylpropyl; and groups made by replacing all or part of the hydrogen atoms bonding to the carbon atoms of the above-mentioned groups with a halogen atom or cyano group, such as chloromethyl group, trifluoropropyl group and cyanoethyl group.

Component (A), the organopolysiloxane, has the ends of the molecular chain blocked with suitable groups such as trimethylsilyl, dimethylvinyl, dimethylhydroxysilyl or trivinylsilyl. This organopolysiloxane should preferably have at least two alkenyl groups, which we mentioned hereinbefore, within its molecule. Specifically, from 0.001 to 5% by mole of the R's, preferably from 0.01 to 5% by mole thereof should be alkenyl groups, especially vinyl groups. Especially when a combination of a platinum catalyst and an organohydrogenpolysiloxane is used as a curing agent, which will be explained hereinafter, an organopolysiloxane with these alkenyl groups is usually employed.

Also, component (A), the organopolysiloxane, may be provided, normally, by co-hydrolysis and co-condensation of one or more of selected organohalosilanes, or ring-opening polymerization of a cyclic polysiloxane, such as a trimer or tetramer of a siloxane in the presence of an alkaline or acidic catalyst. Component (A), the organopolysiloxane, is basically a straight-chain diorganopolysiloxane. However, part of the chain may be branched. Alternatively, it may be a mixture of two or more organopolysiloxanes with different molecular structures. This component, the organopolysiloxane, normally has a viscosity of not less than 100 cSt at 25° C., preferably from 10,000 to 10,000,000 cSt. Also, component (A), the organopolysiloxane, normally has a degree of polymerization of not less than 100, preferably not less than 3,000, with an upper limit of preferably 100,000, particularly preferably 10,000.

Although there is no special limitation on component (B), the filler, a silica filler may be employed. Examples of the silica filler may include filler of fumed silica or precipitated silica. Preferable examples may include surface-treated silica filler with high reinforcing capability, or filler of silica whose surface is treated with a silane-coupling agent represented by the general formula: $RSi(OR')_3$, wherein R denotes glycidyl, vinyl, aminopropyl, methacryloxy, N-phenylaminopropyl, ormercapto; and R' denotes methyl or ethyl. The silane-coupling agent represented by the general formula may be readily available as a commercial product, such as "KBM1003" and "KBE402" produced by Shin-Etsu Chemical Co., Ltd. The silica filler, the surface of which is treated with such a silane-coupling agent, may be provided by a treatment of the surface of the silica filler according to an established method. For the silica filler whose surface is treated with a silane-coupling agent may be employed a commercially available product such as "Zeothix 95" manufactured by J. M. Huber Corporation. The silica filler content should be preferably from 11 to 39 parts by mass, especially preferably from 15 to 35 parts by mass, to 100 parts by mass of component (A), the organopolysiloxane. The silica filler should have a mean particle size of preferably from 1 to 80 μm, particularly preferably from 2 to 40 μm. The mean particle size of the silica filler may be measured as a mean weight diameter (or a median diameter), for example, with a particle size analyzer using a conventional method such as laser diffraction.

Component (C), or the electrically conductive material, is a material that does not belong to the filler (B). Materials, which are different in their form and state from the silica filler defined as filler (B) even if the materials are physically and chemically the same as the silica filler, belong to the electrically conductive material (C). The electrically conductive material is an electric conductivity-imparting component, an example of which may be the electric conductivity-imparting agent described hereinbefore. Among the examples of the agent, preferable is carbon black. The electrically conductive material may be used alone, or two or more of the examples thereof may be used in combination.

The addition-cure milable electrically conductive silicone rubber composition may include additives in such an amount that they do not hinder the achievement of the objective of the present invention. The additives may include, for example, curing agents; colorants; heat-resistance improvers such as iron octoate, iron oxide and cerium oxide; acid acceptors; thermal conductivity improvers; mold release agents; alkoxysilane; dimethylsiloxane oil whose degree of polymerization is smaller than that of the organopolysiloxane (A); silanols such as silanediol; dispersants such as low-molecular-weight siloxanes, both ends of which are blocked with silanol groups, an example of which is α,ω-dimethyl-siloxanediol, and silanes; various carbon-functional silanes to improve adhesiveness, and formability and workability; and various cured and uncured olefin elastomers that do not impede crosslinking reactions.

The addition-cure liquid electrically conductive silicone rubber composition includes (D) an organopolysiloxane with at least two alkenyl groups bonded to silicon atoms in one molecule; (E) an organohydrogenpolysiloxane with at least two hydrogen atoms bonded to silicon atoms in one molecule; (F) an inorganic filler with a mean particle size of 1 to 30 μm and a bulk density of 0.1 to 0.5 g/cm$^3$; (G) an electric conductivity-imparting agent; and (H) a catalyst for addition reaction.

For component (D), the organopolysiloxane, suitable are compounds represented by average composition formula (2) shown below.

$$R^1_a SiO_{(4-a)/2} \quad (2)$$

In this formula, $R^1$'s, which may be the same or different from each other, each denote a substituted or unsubstituted hydrocarbyl group with 1-10 carbon atoms, preferably a substituted or unsubstituted hydrocarbyl group with 1-8 carbon atoms; and a is a positive number from 1.5 to 2.8, preferably from 1.8 to 2.5, more preferably from 1.95 to 2.02.

Examples of the substituent $R^1$ may include an alkyl group, an aryl group, an aralkyl group, an alkenyl group; and groups made by replacing all or part of the hydrogen atoms bonding to the carbon atoms of the above-mentioned groups with a halogen atom or cyano group, as exemplified for R of the organopolysiloxane included in the addition-cure milable electrically conductive silicone rubber composition. It will be preferable if at least two of $R^1$'s included in the entire organopolysiloxane (D) represented by formula are alkenyl groups, especially vinyl groups, and not less than 90% thereof are methyl groups. Specifically, the alkenyl group content of the organopolysiloxane should preferably be from $1.0\times10^{-6}$ to $5.0\times10^{-3}$ mol/g, especially from $5.0\times10^{-6}$ to $1.0\times10^{-3}$ mol/g.

Component (D), the organopolysiloxane, should have such a degree of polymerization that the organopolysiloxane is in a liquid form at room temperature, or 25° C. Alternatively, the viscosity of the organopolysiloxane should be from 100 to 1,000,000 mPa·s, preferably about from 200 to 100,000 mPa·s at 25° C. The organopolysiloxane should have an average degree of polymerization of preferably from 100 to 800, particularly preferably from 150 to 600.

Composition (E), the organohydrogenpolysiloxane, is represented by average composition formula (3) shown below, wherein the organohydrogenpolysiloxane has at least two, preferably not less than three (normally from 3 to 200), more preferably from 3 to 100 hydrogen atoms per molecule, the hydrogen atoms bonded to silicon atoms.

$$R^2_bHCSiO_{(4-b-c)/2} \quad (3)$$

In this formula, $R^2$'s, which may be the same or different from each other, each denote a substituted or unsubstituted hydrocarbyl group with 1-10 carbon atoms; and b is a positive number from 0.7 to 2.1, c is a positive number from 0.001 to 1.0, and b+c is in the range of 0.8 to 3.0.

The amount of the hydrogen atoms bonded to the silicon atoms (Si—H) in the organohydrogenpolysiloxane should preferably be from 0.001 to 0.017 mol/g, particularly from 0.002 to 0.015 mol/g.

This organohydrogenpolysiloxane (E) may include a methylhydroxypolysiloxane both ends of which are blocked with trimethylsiloxy groups, a dimethylsiloxane-methylhydrogen-siloxane copolymer both ends of which are blocked with trimethylsiloxy groups, a dimethylpolysiloxane both ends of which are blocked with dimethylhydrogensiloxy groups, a dimethylsiloxane-methylhydrogensiloxane copolymer both ends of which are blocked with dimethylhydrogensiloxy groups, a methylhydrogensiloxane-diphenylsiloxane copolymer both ends of which are blocked with trimethylsiloxy groups, a methylhydrogensiloxane-diphenylsiloxane-dimethylsiloxane copolymer both ends of which are blocked with trimethylsiloxy groups, a copolymer composed of $(CH_3)_2HSiO_{1/2}$ repeat units and $SiO_{4/2}$ repeat units, and a copolymer composed of $(CH_3)_2HSiO_{1/2}$ repeat units, $SiO_4$ repeat units and $(C_6H_5)SiO_{3/2}$ repeat units.

The amount of the organohydrogenpolysiloxane (E) should be preferably from 0.1 to 30 parts by mass, particularly preferably from 0.3 to 20 parts by mass, to 100 parts by mass of the organopolysiloxane (D). Also, the ratio of the moles of the hydrogen atoms bonded with the silicone atoms in the organopolysiloxane (D) to themoles of the alkenyl groups therein should be preferably from 0.3 to 5.0, particularly preferably from 0.5 to 2.5.

Component (F), the inorganic filler, is an important component to provide a roller with low compression set, stable volume resistivity with lapse of time and sufficient durability. The inorganic filler has a mean particle size from 1 to 30 μm, preferably from 2 to 20 μm, and a bulk density from 0.1 to 0.5 g/cm$^3$, preferably from 0.15 to 0.45 g/cm$^3$. When the mean particle size is smaller than 1 μm, the electrical resistivity may vary with lapse of time; when the mean particle size is larger than 30 μm, the durability of the elastic layer 3 may be lowered. Also, a bulk density of smaller than 0.1 g/cm$^3$ may cause the compression set to deteriorate and the electrical resistivity to vary with time, while a bulk density of larger than 0.5 μm may provide the elastic layer 3 with insufficient strength, which leads to deterioration in the durability. The mean particle size may be measured as a mean weight diameter (or a median diameter), for example, with a particle size analyzer using a conventional method such as laser diffraction. The bulk density may be calculated based on the method of determining apparent specific gravity in accordance with JIS K 6223.

Examples of the inorganic filler (F) may include diatomaceous earth, perlite, mica, calcium carbonate, glass flakes, and hollow fillers. Among them, ground products of diatomaceous earth, perlite and expanded perlite are preferable.

The amount of the inorganic filler (F) should be preferably from 5 to 100 parts by mass, particularly preferably from 10 to 80 parts by mass, to 100 parts by mass of the organopolysiloxane (D).

Component (G), the electric conductivity-imparting agent, is the same as the one which was explained hereinbefore. The amount of the agent should be from 2 to 80 parts by mass to 100 parts by mass of the organopolysiloxane (D).

Examples of the catalyst for addition reaction (H) may include platinum black, platinum(IV)chloride, chloroplatinic acid, a reaction product of chloroplatinic acid and a monohydric alcohol, a chloroplatinic acid-olefin complex, platinum bis-acetoacetate, palladium catalysts and rhodium catalysts. A very small amount of the catalyst would be sufficient for addition reaction (H). The platinum group metal content should be preferably from 0.5 to 1,000 ppm to the total of the mass of the organopolysiloxane (D) and that of the organohydrogen-polysiloxane. It should be particularly preferable, if the content is approximately from 1 to 500 ppm.

The addition-cure liquid electrically conductive silicone rubber composition may include, in addition to the components explained hereinbefore, an ester of a low molecular weight siloxane; a dispersant such as silanol, a particular example of which is diphenylsilandiol; a heat-resistance improver such as iron octoate, iron oxide and cerium oxide; various carbon-functional silanes to improve adhesiveness, and formability and workability; and a halogen compound imparting incombustibility, in such an amount that they do not hamper the achievement of the objective of the present invention.

The addition-cure liquid electrically conductive silicone rubber composition should have a viscosity from 5 to 500 Pa·s, especially from 5 to 200 Pa·s at 25° C.

The urethane coat layer 4 is made by curing a urethane resin composition, which will be explained hereinafter, on the outer circumferential surface of the elastic layer 3. The urethane coat layer includes at least one ionic liquid selected from the group consisting of pyridinium ionic liquids and amine ionic liquids in an amount from 1 to 20 parts by mass to 100 parts by mass of a urethane resin.

The ionic liquid included in the urethane coat layer 4 is a sort of an onium salt, a liquid compound which has high electric conductivity and which is in a liquid state at a temperature of at least around room temperature. For the present invention it is important that the ionic liquid is, inter alia, at least one selected from the group consisting of pyridinium ionic liquids and amine ionic liquids. When the ionic liquid is one selected from the group, it is capable of essentially preventing the occurrence of fogging in a low humidity environment, which leads to satisfactory achievement of the objective of the present invention. The ionic liquid may be one of them or a mixture of them, as long as it is selected from the group.

The ionic liquid should preferably be at least one selected from the pyridinium ionic liquids, because pyridinium ionic liquids are capable of essentially preventing the occurrence of fogging in a low humidity environment and therefore achieving the objective of the present invention very well.

The pyridinium ionic liquids are those including pyridinium ions, as cations, each pyridinium ion formed from a pyridine ring whose nitrogen atom is bonded with a substituent such as an alkyl group. The alkyl group may preferably be a straight-chain alkyl group with 1 to 18 carbon atoms, which may have substituents, or a branched-chain or cyclic alkyl group. Particularly preferable is a straight-chain alkyl group with 4 to 18 carbon atoms. Examples of the alkyl group may include methyl, ethyl, propyl, isopropyl, butyl, isobutyl, sec-butyl, tert-butyl, pentyl, neopentyl, hexyl, isohexyl, decyl, dodecyl, octadecyl, cyclopentyl and cyclohexyl.

The pyridine ring may be an alkyl-substituted pyridine ring wherein at least one of the hydrogen atoms bonded to the carbon atoms that form the ring is replaced with an alkyl group. A single alkyl group or alkyl groups may replace a hydrogen atom or hydrogen atoms. The alkyl group is basically the same as the alkyl group bonded to the nitrogen atom of the pyridine ring, and it should preferably be a straight-chain alkyl group with 1 to 18 carbon atoms, which may have substituents, or a branched-chain or cyclic alkyl group. Particularly preferable is a straight-chain alkyl group with 4 to 18 carbon atoms. Examples of the alkyl-substituted pyridine may include α-picoline, β-picoline and γ-picoline that have one methyl group as the alkyl group; α-ethylpyridine, β-ethylpyridine and γ-ethylpyridine that have one ethyl group as the alkyl group; and 2,3-lutidine, 2,4-lutidine, 2,6-lutidine and 3,4-lutidine that have two methyl groups as the alkyl groups. Among them γ-picoline is preferable.

There is no special limitation on anions included in the pyridinium ionic liquids. Examples of the anions may include halogen ions, $BF_4^-$, $PF_6^-$, $CF_3SO_3^-$ (trifluoromethanesulfonyl ion), and $(CF_3SO_2)_2N^-$ (bis(trifluoromethanesulfonyl) imide ion, which is often abbreviated to TFSI). Among them, preferable are $BF_4^-$, $PF_6^-$, $CF_3SO_3^-$ and $(CF_3SO_2)_2N^-$, which are organic acid ions, with $(CF_3SO_2)_2N^-$ particularly preferable.

Examples of the pyridinium ionic liquids, which have pyridinium ions not substituted with the alkyl group as cations, and bis(trifluoromethanesulfonyl)imide ions as anions, may include N-propylpyridinium bis(trifluoromethanesulfonyl) imide, N-butylpyridinium bis(trifluoromethanesulfonyl) imide, N-pentylpyridinium bis(trifluoromethanesulfonyl) imide, N-hexylpyridinium bis(trifluoromethanesulfonyl) imide, N-heptylpyridinium bis(trifluoromethanesulfonyl) imide, N-octylpyridinium bis(trifluoromethanesulfonyl) imide, N-nonylpyridinium bis(trifluoromethanesulfonyl) imide, N-decylpyridinium bis(trifluoromethanesulfonyl) imide, and N-allylpyridinium bis(trifluoromethanesulfonyl) imide.

Examples of the pyridinium ionic liquids, which have pyridinium ions substituted with the alkyl group as cations, and bis(trifluoromethanesulfonyl)imide ions as anions, may include N-propyl-2-methylpyridinium bis(trifluoromethanesulfonyl)imide, N-butyl-2-methylpyridinium bis(trifluoromethanesulfonyl)imide, N-pentyl-2-methylpyridinium bis (tri-fluoromethanesulfonyl)imide, N-hexyl-2-methylpyridinium bis(trifluoromethanesulfonyl)imide, N-heptyl-2-methyl-pyridinium bis(trifluoromethanesulfonyl)imide, N-octyl-2-methylpyridinium bis(trifluoromethanesulfonyl)imide, N-nonyl-2-methylpyridinium bis (trifluoromethanesulfonyl) imide, N-decyl-2-methylpyridinium bis(trifluoromethane-sulfonyl)imide, N-propyl-3-methylpyridinium bis(trifluoro-methanesulfonyl)imide, N-butyl-3-methylpyridinium bis(tri-fluoromethanesulfonyl)imide, N-pentyl-3-methylpyridinium bis (trifluoromethanesulfonyl)imide, N-hexyl-3-methylpyridinium bis(trifluoromethanesulfonyl)imide, N-heptyl-3-methylpyridinium bis(trifluoromethanesulfonyl)imide, N-octyl-3-methylpyridinium bis(trifluoromethanesulfonyl) imide, N-nonyl-3-methylpyridinium bis(trifluoromethanesulfonyl)imide, N-decyl-3-methylpyridinium bis(trifluoromethanesulfonyl) imide, N-propyl-4-methylpyridiniumbis (tri-fluoromethanesulfonyl)imide, N-butyl-4-methylpyridinium bis(trifluoromethanesulfonyl)imide, N-pentyl-4-methyl-pyridinium bis(trifluoromethanesulfonyl)imide, N-hexyl-4-methylpyridinium bis(trifluoromethanesulfonyl)imide, N-heptyl-4-methylpyridinium bis (trifluoromethanesulfonyl) imide, N-octyl-4-methylpyridinium bis(trifluoromethane-sulfonyl)imide, N-nonyl-4-methylpyridinium bis(trifluoro-methanesulfonyl) imide, and N-decyl-4-methylpyridinium bis(trifluoromethanesulfonyl)imide. Furthermore, examples of the pyridinium ionic liquids, which have pyridinium ions substituted with the alkyl group as cations, and hexafluoro-phosphate ions as anions, may include 1-octyl-4-methyl-pyridinium hexafluorophosphate, 1-nonyl-4-methylpyridinium hexafluorophosphate, and 1-octyl-4-methylpyridinium hexafluorophosphate.

The amine ionic liquids are liquids including ammonium ions, as cations, each ammonium ion formed from an aliphatic-type amine compound whose nitrogen atom is bonded with a substituent such as an alkyl group. The alkyl group is basically the same as that alkyl group which is bonded to the nitrogen atom in the pyridinium ionic liquids.

The aliphatic-type amine compound may include, for example, alicyclic amine compounds and aliphatic amine compounds. The ammonium ions formed from these amine compounds may include $R^1{}_4N^+$ ions, wherein four $R^1$'s may be the same or different from each other, each of $R^1$'s denotes a straight-chain, branched-chain or cyclic alkyl group with 1 to 18 carbon atoms, and more than one of $R^1$'s may form at least one ring.

Examples of the amine ionic liquids whose four alkyl groups $R^1$'s are the same may include N,N,N,N-tetrabutylammonium bis(trifluoromethanesulfonyl)imide, N,N,N,N-tetrapentyl-ammonium bis(trifluoromethanesulfonyl)imide, N, N, N, N-tetra-hexylammonium bis(trifluoromethanesulfonyl)imide, N,N,N,N-tetraheptylammonium bis(trifluoromethanesulfonyl)imide, N,N,N,N-tetraoctylammonium bis(trifluoromethanesulfonyl) imide, N,N,N,N-tetranonylammonium bis(trifluoromethane-sulfonyl)imide, N,N,N,N-tetradecylammonium bis(trifluoro-methanesulfonyl)imide, N,N,N,N-tetradodecylammonium bis(trifluoromethanesulfonyl)imide, N,N,N,N-tetrahexadecyl-ammonium bis(trifluoromethanesulfonyl)imide, and N,N,N,N-tetraoctadecylammonium bis(trifluoromethanesulfonyl)imide.

Examples of the amine ionic liquids wherein three of the alkyl groups $R^1$'s are the same may include N,N,N-trimethyl-N-propylammonium bis(trifluoromethanesulfonyl)imide, N,N,N-trimethyl-N-butylammonium bis(trifluoromethanesulfonyl) imide, N,N,N-trimethyl-N-pentylammonium bis (trifluoro-methanesulfonyl)imide, N,N,N-trimethyl-N-hexylammonium bis(trifluoromethanesulfonyl)imide, N,N,N-trimethyl-N-heptylammonium bis (trifluoromethanesulfonyl)imide, N,N,N-trimethyl-N-octylammonium bis(trifluoromethanesulfonyl) imide, N,N,N-trimethyl-N-nonylammonium bis(trifluoromethanesulfonyl)imide, and N,N,N-trimethyl-N-decylammonium bis(trifluoromethanesulfonyl)imide.

Known urethane resin would suffice for the urethane resin included in the urethane coat layer 4, and such urethane resin is normally produced from a polyol and a polyisocyanate. In order to achieve the objective of the present invention sufficiently, the polyol should preferably be a polyester polyol or a polyether polyol. Also, the polyisocyanate may be, for example, an aliphatic polyisocyanate or an aryl polyisocyanate.

The urethane coat layer 4 may include various additives that are usually added to various urethane resin compositions.

It may include an electric conductivity-imparting agent, such as carbon black, as an optional component.

The urethane coat layer 4 includes the ionic liquid in an amount from 1 to 20 parts by mass to 100 parts by mass of the urethane resin. When the ionic liquid content is less than 1 part by mass, the ionic liquid is not capable of taking an effect on the performance of the roller, which may result in a failure in achieving the objective of the invention. On the other hand, the ionic liquid in excess of 20 parts by mass may cause the charged toner to lose its electric charge, which may make the developing roller unable to carry the toner on its surface. When such a developing roller is installed in an image-forming device, it is prone to see fogging in a low humidity environment and density irregularity in halftone images, which may lead to deterioration in the quality of formed images. In order to essentially prevent the occurrence of fogging in a low humidity environment and achieve the objective of the present invention, the ionic liquid content should preferably be from 9 to 19 parts by mass to 100 parts by mass of the urethane resin.

The urethane coat layer 4 should normally have a thickness from 0.1 to 50 μm, especially from 10 to 25 μm.

The urethane resin composition to be formed into the urethane coat layer 4 includes urethane-producing components, which are precursors to produce the urethane resin, the ionic liquid in a predetermined amount, i.e. from 1 to 20 parts by mass to 100 parts by mass of the urethane-producing components, and various additives if desired. The urethane resin composition, which includes the urethane-producing components, the ionic liquid in the predetermined amount, and the various additives if desired, is applied to the outer circumferential surface of the elastic layer 3, and then cured. The urethane coat layer 4 is thus formed. The ionic liquid and various additives in the urethane resin composition are those described hereinbefore.

Components capable of producing polyurethane would suffice for the urethane-producing components, and examples of the components may include a mixture of a polyol and a polyisocyanate.

The polyol includes various polyols that are usually used for the production of polyurethane. The polyol should preferably be at least one selected from polyether polyols and polyester polyols. Examples of the polyether polyols may include polyalkylene glycols such as polyethylene glycol, polypropylene glycol and polypropylene glycol-ethyleneglycol; polytetramethylene ether glycol; copolymer polyols of tetrahydrofuran and an alkyleneoxide; and various modified compounds and mixtures thereof. Examples of the polyester polyols may include condensed polyester polyols provided by condensation of a dicarboxylic acid, such as adipic acid, and a polyol, such as ethylene glycol and hexanediol; lactone polyester polyols; polycarbonate polyols; and mixtures thereof. The polyether polyols and polyester polyols may be used singly or in combination. Also, combinations of a polyether polyol and a polyester polyol may be employed. The polyol should preferably be a polyester polyol because it is excellent in thermal stability. The polyol should have preferably a number average molecular weight from 1000 to 8000, more preferably from 1000 to 5000. The number average molecular weight is a molecular weight by gel permeation chromatography (GPC), converted to polystyrene standard.

Various isocyanates that are usually used for the production of polyurethane would suffice for the isocyanate. It may include, for example, aliphatic isocyanates, aryl isocyanates and derivatives thereof. The isocyanate should preferably be an aryl isocyanate, because the aryl isocyanate is excellent in storage stability and the rate of the reaction between the polyisocyanate and the polyol is capable of being controlled easily. Examples of the aryl isocyanate may include xylylene diisocyanate (XDI), diphenylmethane diisocyanate (MDI), toluene diisocyanate, which is also called tolylene diisocyanate (TDI), 3,3'-bitolylene-4,4'-diisocyanate, 3,3'-dimethyldiphenylmethane-4,4'-diisocyanate, 2,4-tolylene diisocyanate uretidinedione (a dimer of 2,4-TDI), xylene diisocyanate, naphthalene diisocyanate (NDI), p-phenylene diisocyanate (PDI), tolidine diisocyanate (TODI), and m-phenylene diisocyanate. Examples of the aliphatic isocyanate may include hexamethylene diisocyanate (HDI), 4,4'-dicyclohexylmethane diisocyanate (hydrogenated MDI), o-toluidine diisocyanate, lysine diisocyanate methyl ester, isophoronediisocyanate(IPDI),norbornanediisocyanatemethyl, trans-cyclohexane-1,4-diisocyanate, and triphenylmethane-4,4',4"-triisocyanate. The derivatives may include multimers of the polyisocyanate, polyisocyanates reacted with e.g. a small amount of a polyol, including urethane prepolymers, dimers resulting from the formation of uretidione, isocyanurates, carbodimides, uretonimine, allophanate, urea, and biuret. The polyisocyanates may be used singly or in combination. The polyisocyanate should have a molecular weight of preferably from 500 to 2000, more preferably from 700 to 1500.

There is no special limitation on the mixing proportion in a mixture of the polyol and polyisocyanate. Normally, the molar ratio (NCO/OH) of isocyanate groups (NCO) included in thepolyisocyanatetohydroxyl groups (OH) included in the polyol should be from 0.7 to 1.15. This molar ratio (NCO/OH) should preferably be from 0.85 to 1.1, because the molar ratio within this range leads to the prevention of hydrolysis of polyurethane. In actual production, however, the amount of polyisocyanate may be from three to four times as large as the amount that falls within the proper molar ratio; in view of working environment and errors during the operation.

The urethane-producing components may include, in addition to the polyol and polyisocyanate, auxiliaries that are usually used in the reaction between a polyol and a polyisocyanate, such as chain extenders and crosslinking agents. Examples of the chain extenders and crosslinking agents may include glycols, hexanetriol, trimethylolpropane and amines.

The electrically conductive roller 1 is produced by forming an elastic layer 3 on the outer circumferential surface of a shaft 2, and then forming a urethane coat layer 4 on the outer circumferential surface of the elastic layer 3. As a first step of producing the electrically conductive roller 1, a shaft 2 is prepared. The shaft 2 is formed into a desired shape by, for example, known methods. A primer may be applied to the shaft 2 before the formation of the elastic layer 3. There is no special limitation on the primer to be applied to the shaft 2. Examples of the primer may include the same resins and crosslinking agents as those used to form a primer layer with the aid of which the elastic layer 3 and the urethane coat layer 4 contact or adhere to each other, which primer layer will be described hereinafter. The primer may be dissolved in a medium such as a solvent if desired, and may be applied to the outer circumferential surface of the shaft by the usual method, such as dipping or spraying.

The elastic layer 3 is formed, by heating the electrically conductive composition that has been applied onto the outer circumferential surface of the shaft 2 to cure the composition on the surface. For example, the heating and curing of the electrically conductive composition and the forming the elastic layer 3 on the outer circumferential surface of the shaft 2 are carried out simultaneously or in succession by known methods. The curing of the electrically conductive composition may be done by any method that is capable of providing the composition with heat necessary to cure it. The forming of the elastic layer 3 may also be done by any suitable method, such as continuous vulcanization through extrusion molding, press, or die forming through injection. For example, when the electrically conductive composition is an addition-cure milable electrically conductive silicone rubber composition, extrusion molding or similar methods may be selected. On the other hand, when the electrically conductive composition is an addition-cure liquid electrically conductive silicone rubber composition, for example, molding using a die may be selected. The temperature and time period for the heating employed to cure the electrically conductive composition varies depending on the composition. Specifically, when the composition is an addition-cure milable electrically conductive silicone rubber composition, the temperature is preferably from 100 to 500° C., particularly from 120 to 300° C., and the time period is preferably from several seconds to not more than one hour, particularly from 10 seconds to 35 minutes. When the composition is an addition-cure liquid electrically conductive silicone rubber composition, the temperature is preferably from 100 to 300° C., particularly from 110 to 200° C., and the time period is preferably from 5 minutes to 5 hours, particularly from 1 hour to 3 hours. As the need arises, a secondary vulcanization may be carried out, under the conditions that the temperature is from 100 to 200° C. and the time period is approximately from 1 to 20 hours for an addition-cure milable electrically conductive silicone rubber composition, and under the conditions that the temperature is from 120 to 250° C. and the time period is approximately from 2 to 70 hours for an addition-cure liquid electrically conductive silicone rubber composition. A sponge-like elastic layer containing air bubbles may also be produced from the electrically conductive composition easily by known expansion and cure methods.

The surface of the elastic layer 3 thus formed may be ground and polished, if it is desired, so that the outer diameter of a cylinder consisting of the shaft and the elastic layer 3 and the conditions of the surface the elastic layer will be adjusted. Before the formation of the urethane coat layer 4, the primer layer may be formed on the elastic layer 3.

The urethane coat layer 4 is formed by applying the urethane resin composition onto the outer circumferential surface of the elastic layer 3 or primer layer, which has been formed on the elastic layer in some cases where it is desirable, and then heating and curing the applied urethane resin composition. The application of the urethane resin composition may be carried out by known methods, examples of which may include coating in which the surface is coated with a coating liquid of the urethane resin composition, dipping in which the roller under production with the elastic layer 3 is immersed in the coating liquid, and spray coating in which the coating liquid is sprayed onto the elastic layer 3. The urethane resin composition may be applied as it is. Instead of undiluted urethane resin composition may be employed a coating liquid including the urethane resin composition, and volatile solvents whose examples may include alcohols such as methanol and ethanol, aromatic solvents such as xylene and toluene, ester solvents such as ethyl acetate and butyl acetate, or water. The curing of the urethane resin composition thus applied may be carried out by any method that is capable of providing the composition with heat or moisture necessary to cure it. Examples of the method may include heating the roller under production with the elastic layer 3 which has been coated with the urethane resin composition, with a heater, and leaving the roller under production with the elastic layer 3 which has been coated with the urethane resin composition, under high humidity. The temperature employed for heating and curing the urethane resin composition is preferably from 100 to 200° C., particularly from 120 to 160° C., and the time period therefor is preferably from 10 to 120 minutes, particularly from 30 to 60 minutes. In place of the coating, the urethane resin composition may be laminated on the outer circumferential surface of the elastic layer 3 or primer layer, by known molding methods, such as extrusion molding, pressing, and injection molding. Simultaneously as the molding or subsequent thereto, the laminated urethane resin composition is cured.

The electrically conductive roller 1 thus produced, which is provided with the urethane coat layer 4 including the urethane resin in an amount of 100 parts by mass and the ionic liquid in an amount from 1 to 20 parts by mass, or from 1 to 20 parts by mass of the ionic liquid to 100 part by mass of the urethane resin, is capable of essentially preventing the occurrence of fogging even in a low humidity environment, such as an environment of 10% relative humidity, as well as in a normal humidity environment. The inventors assume the reason that the electrically conductive roller 1 has this excellent advantage in the following way: Even if a toner supplied to the image carrier is overcharged in a low humidity environment, the electrically conductive roller 1 with the urethane coat layer 4 as a surface layer will effectively remove the excessive static charge from the toner to make the quantity of static charge to be supplied to the image carrier approximately the same as that of static charge in a normal humidity environment.

The electrically conductive roller 1 is capable of essentially preventing the occurrence of fogging, when the humidity of the surrounding area decreases from, for example, normal humidity to a low humidity. Therefore this invention achieves the objective of the invention, or provides an electrically conductive roller and an image-forming device capable of forming fogging-free images.

Because the electrically conductive roller 1 is capable of essentially preventing the occurrence of fogging when the surrounding area is under low humidity, it is especially suitable for a developing roller and a toner-supplying roller, both of which carry on them a toner with a desired quantity of static charge in a uniform thickness and supply the toner to the image carrier.

Figure 2:
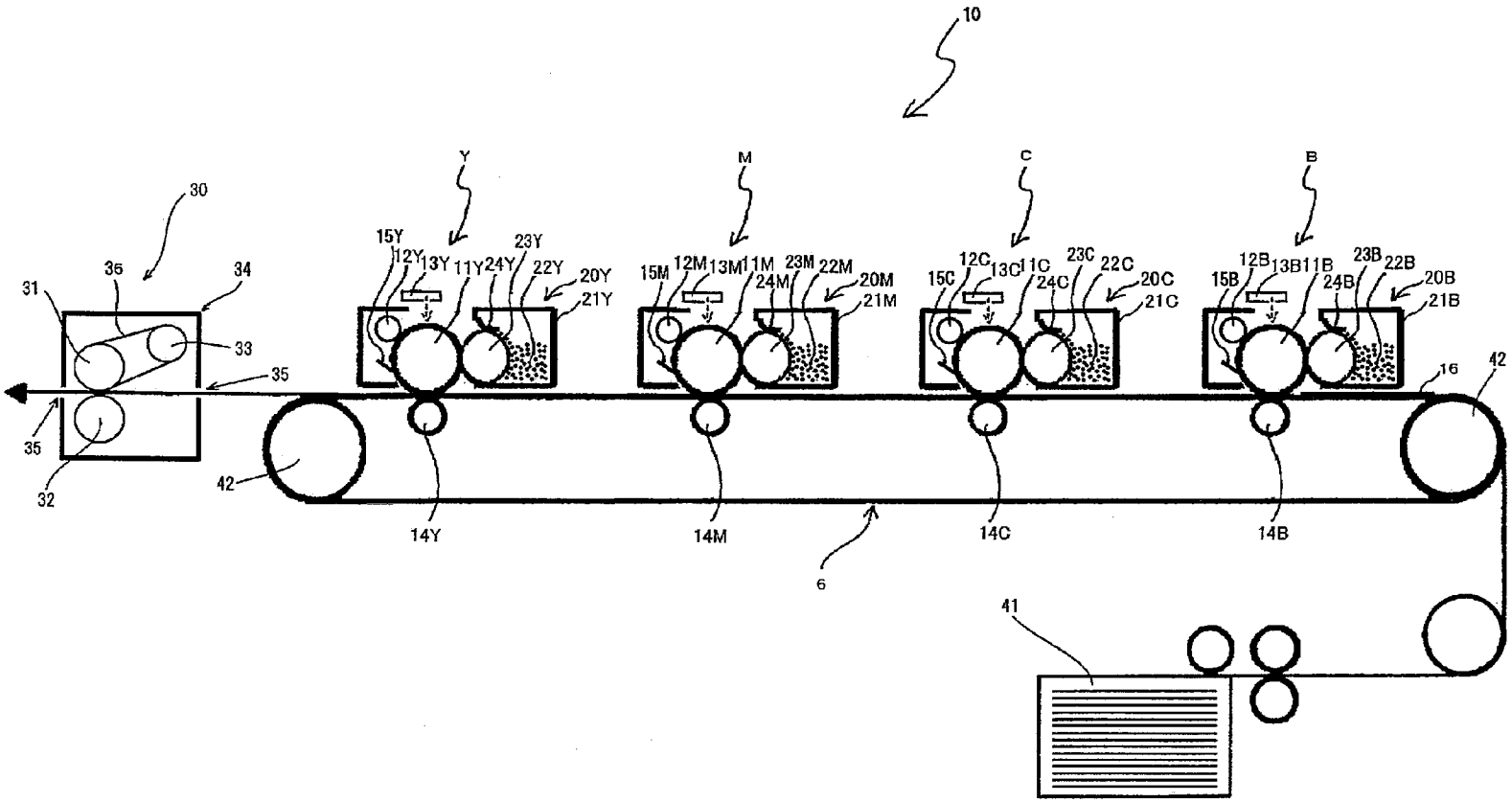
FIG. 2 is a schematic diagram showing an example of the image-forming device according to the present invention.

In the following, an example of the image-forming device equipped with the electrically conductive roller 1 according to the present invention, which image-forming device may be called image-forming device according to the present invention hereafter, will be explained, with reference to FIG. 2. As shown in FIG. 2, this image-forming device 10 is a tandem color image-forming device which has developing units B, C, M and Y, each for a color, respectively provided with image carriers 11B, 11C, 11M and 11Y, wherein the image carriers are arranged in series on a transfer and conveyor belt 6. In other words, the developing units B, C, M and Y are arranged in series on the belt 6. The developing unit B has an image carrier 11B, such as a photoreceptor, which is also called photoconductor drum; a static charger 12B, such as a charge roller; an exposing device 133; a developing device 20B; a transfer device 14B, such as a transfer roller; and a cleaner 15B. The developing device 20B has a housing 21B for containing a nonmagnetic monocomponent toner 22B, and a toner carrier 23B for supplying the toner 22B to the image carrier 11B, such as a developing roller; and a toner-amount adjuster 24B for adjusting a thickness of the toner 22B on the surface of the toner carrier, such as a blade. The developing units C, M and Y are essentially the same as the developing unit B. A fixing device 30 is arranged downstream of the developing unit Y. The fixing device has a housing with an opening 35 through which a recording material 16 passes.

The fixing device also accommodates, in the housing, a fixing roller 31; an endless belt-supporting roller 33 placed in the proximity of the fixing roller 31; an endless belt 36 wound on the fixing roller 31 and the endless belt-supporting roller 33; and a pressure roller 32 so disposed as to face the fixing roller 31, wherein the fixing roller 31 and the pressure roller 32 are arranged so that they contact or press each other with the endless belt 36 in between and they are free to rotate. A cassette 41 for containing the recording material 16 is placed on the bottom of the image-forming device 10. The transfer and conveyor belt 6 is wound on several supporting rollers 42.

Each of the toners 22B, 22C, 22M and 22Y used in the image-forming device 10 may be a dry toner or a wet-suspended toner, or a nonmagnetic toner or a magnetic toner, as long as it is capable of being charged by friction. The housings 21B, 21C, 21M and 21Y of the developing units contain nonmagnetic monocomponent black toner, nonmagnetic monocomponent cyan toner, nonmagnetic monocomponent magenta toner and nonmagnetic monocomponent yellow toner, respectively. Electrically conductive rollers 1 of the invention are employed as the toner carriers 23B, 23C, 23M and 23Y, or developing rollers, in the image-forming device 10.

The image-forming device 10 forms a color image on the recording material 16 in the following way: Firstly, in the developing unit B, an electrostatic latent image is formed on the surface of the image carrier 11B that has been charged with the static charger 12B with the aid of the exposing device 13B. Subsequently, the latent image is developed with the toner 22B supplied by the toner carrier 23B, and a corresponding black precursory image is formed. Then, the black precursory image is transferred to the surface of the recording material 16B so that a black image is formed on the material, while the recording material 16B is passing between the transfer device 14B and the image carrier 11B. A cyan image, a magenta image and a yellow image are superimposed on the black image, which has been developed from the latent image and transferred on the recording material, in the developing units C, M and Y in the same way as in the developing unit B. A color image thus appears on the recording material. Finally, the color image is fixed on the recording material 16 as a permanent image by the fixing device 30. A permanent color image is formed on the recording material 16 in this way.

It is assumed that the employment of the electrically conductive rollers 1 for the toner carriers 23 in this tandem image-forming device 10 leads to the removal of excessive static charge from the toner by the electrically conductive roller 1. The tandem image-forming device 10 equipped with the electrically conductive rollers 1 is capable of forming images essentially free of fogging even in a low humidity environment, such as an environment of 10% relative humidity, as well as in a normal humidity environment.

The image-forming device 10 may be employed in, for example, photocopiers, facsimiles and printers. The image-forming device 10 was explained hereinbefore with reference to an example where the electrically conductive rollers 1 were used as developing rollers, which are an example of the toner carrier 23. The employment of the electrically conductive rollers 1 according to the present invention as toner-supplying rollers will also provide images of high quality as well.

The electrically conductive roller and image-forming device of the present invention are not limited to the foregoing examples, but are able to be variously modified within the gist and spirit of the present invention, or as long as the objective of the present invention is capable of being achieved.

The electrically conductive roller 1 of the present invention may have other layers between the elastic layer 3 and the urethane coat layer 4. An example of the other layers may be a primer layer for sticking the elastic layer 3 and the urethane coat layer 4 together or closely contacting them with each other. Materials for the primer layer may include alkyd resin, phenol-modified or silicone-modified alkyd resin, oil-free alkyd resin, acrylic resin, silicone resin, epoxy resin, fluororesin, phenol resin, polyamide resin, urethane resin, and mixtures thereof. The crosslinking agent to cure and/or crosslink these resins may include, for example, isocyanate compounds, melamine compounds, epoxy compounds, peroxides, phenol compounds and hydrogensiloxanes. The primer layer may be formed so as to have a thickness, for example, from 0.1 to 10 μm.

The image-forming device 10 is an electrophotographic one in the foregoing explanation. The image-forming device of the present invention, however, is not limited to electrographic ones, but may be applied to electrostatic image-forming devices. Also, the image-forming device equipped with the electrically conductive rollers 1 of the present invention is not limited to the tandem color image-forming device in which several image carriers, each equipped with a developing unit of a color, are arranged on the transfer and conveyor belt in series, but may be applied to other devices such as monochrome image-forming devices equipped with a single developing unit, and 4-cycle color image-forming devices in which a primary transfer of a precursory image with a color toner carried on an image carrier to an endless belt is repeated. Furthermore, in the foregoing explanation of the image-forming device 10, the toner 22 was a nonmagnetic monocomponent toner. However, magnetic monocomponent toners, nonmagnetic dicomponent toners and magnetic dicomponent toners may be used as well in the device of the present invention.

EXAMPLES

Working Example 1

A shaft (made of SUM22, 10 mm in diameter and 275 mm in length) treated by electroless nickel plating was washed with ethanol. The surface of the washed shaft was coated with a silicone primer (product name: Primer No. 16, produced by Shin-Etsu Chemical Co., Ltd.). The shaft, which had been coated with the primer, was fired at a temperature of 150° C. for 10 minutes in a Geer oven. Subsequently, the fired was cooled at room temperature for not less than 30 minutes. A primer layer was thus formed on the surface of the shaft.

Then, 100 parts by mass of dimethylpolysiloxane both ends of which are blocked with dimethylvinylsiloxy groups (D) (degree of polymerization: 300), 1 part by mass of hydrophobic-treated fumed silica with a BET specific surface area of 110 $m^2/g$ (product name: R-972, produced by Nippon Aerosil Co., Ltd.), 40 parts by mass of diatomaceous earth with a mean particle size of 6 μm and a bulk density of 0.25 $g/cm^3$ (F) (product name: Oplite W-3005S, produced by Hokushu-Keisodo Co., Ltd.), and 5 parts by mass of acetylene black (G) (product name: DENKA BLACK HS-100, produced by DENKI KAGAKU KOGYO KABUSHIKI KAISHA) were placed in a planetary mixer. The contents in the mixer were stirred for 30 minutes, and were allowed to pass through a triple roll mill. The resultant was returned to the planetary mixer. 2.1 parts by mass of methylhydrogenpolysiloxane with Si—H groups at both ends and side chains (E) as a crosslinking agent (degree of polymerization: 17, Si—H content: 0.0060 mol/g), 0.1 part by mass of ethynylcyclohexanol as a reaction-controlling agent, and 0.1 part by mass of a platinum catalyst (H) (Pt content: 1%) were also introduced into the planetary mixer. The resulting contents were stirred and kneaded for 15 minutes. An addition-cure liquid electrically conductive silicone rubber composition was thus prepared. The prepared addition-cure liquid electrically conductive silicone rubber composition was formed into a precursory layer on the outer circumferential surface of the shaft 2 by liquid injection molding. During the liquid injection molding, the addition-cure liquid electrically conductive silicone rubber composition was heated at 150° C. for 10 minutes and cured. The cured precursory layer was polished. Thus an elastic layer 3 with an outer diameter of 20 mm was formed.

On the other hand, a urethane resin composition with the following composition for the urethane coat layer 4 was prepared.

- polyisocyanate (hexamethylene diisocyanate): 14 parts by mass
- condensed polyester polyol wherein the molar ratio of adipic acid to 1,6-hexanediol is [COOH/OH]=12/13: 28 parts by mass (wherein the molar ratio of the polyisocyanate to the polyester polyol is [NCO/OH]=1.1/1)
- $C_5H_5N^+$—$C_6H_{13}$-$[(CF_3SO_2)_2N]^-$ (N-hexylpyridinium bis (trifluoro-methanesulfonyl) imide) (produced by KANTO CHEMICAL CO., LTD.) as ionic liquid: 1 part by mass
- carbon black (product name: TOKABLACK #4500, produced by Tokai Carbon Co., Ltd.): 3 parts by mass
- dibutyltin dilaurate (product name: di-n-butyltin dilaurate, produced by SHOWA CHEMICAL CO., LTD.) as additive 1: 0.03 part by mass
- silica (product name: ACEMATT OK-607, produced by Degussa AG) as additive 2: 4 parts by mass The urethane resin composition thus prepared was applied to the outer circumferential surface of the elastic layer 3 by spray-coating and then heated at 160° C. for 30 minutes. A urethane coat layer 4 with a thickness of 22 μm was formed. The electrically conductive roller of Working Example 1 was produced in this way.

Working Examples 2-4

The electrically conductive rollers of Working Examples 2-4 were produced by the essentially same method as in Working Example 1, except that the amount of the ionic liquid was changed to 2 parts by mass, 4 parts by mass and 8 parts by mass, respectively.

Working Examples 5-8

The electrically conductive rollers of Working Examples 5-8 were produced by the essentially same methods as respectively in Working Examples 1-4, except that $(CH_3)_3N^+C_3H_6$-$[(CF_3SO_2)_2N]^-$ (N,N,N-trimethyl-N-propylammonium bis (trifluoromethane-sulfonyl) imide), an amine ionic liquid, was used in place of the pyridinium ionic liquid.

Comparative Example 1

The electrically conductive roller of Comparative Example 1 was produced by the essentially same method as in Working Example 1, except the urethane resin composition did not include the pyridinium ionic liquid.

Comparative Example 2

The electrically conductive roller of Comparative Example 2 was produced by the essentially same method as in Working Example 1, except the urethane resin composition did not include the pyridinium ionic liquid and the amount of carbon black was changed to 6 parts by mass.

(Evaluation of Fogging in Low Humidity Environment)

Each of the electrically conductive rollers, produced in the working and comparative examples, was installed in an electrophotographic printer using nonmagnetic monocomponent toners (product name: HL-4040CN, manufactured by Brother Industries, Ltd.). Then, the roller-installed printer was left for 24 hours in a low humidity environment, or at 23° C. and 10% relative humidity. Then, the print options of the printer were selected in the following way: The paper quality was set to "thick plain paper", the printing quality to "standard", and the color to "standard". One hundred copies of a solid white image were continuously printed in a monochrome mode. Immediately after this printing, a copy of the solid white image was printed in a color mode. Printing blots on the resulting solid white print were checked as fogging by the eye. When there was no blot on the entire image, it was graded as Excellent, which is shown as "◎" in Table 1 below. When there were such a small number of blots on the solid white print that they would not cause practical problems, it was graded as Fair, which is shown as "○" in the table. When there were such a number of blots on the image that the image could not be acceptable from a practical viewpoint, it was graded as Failure, which is shown as "x" in the table. The results of the evaluation are shown in Table 1 in the column of "Evaluation of fogging", or column D.

(Evaluation of Image Quality of Halftone Images)

The printer (product name: HL-4040CN, manufactured by Brother Industries, Ltd.), in which each of the electrically conductive rollers had been installed, was connected with a personal computer. Then, the printer was left for 24 hours in a test environment, or at 23° C. and 10% relative humidity. Then, the print options of the printer were selected in the following way: The paper quality was set to "thick plain paper", the printing quality to "standard", the color to "standard", and other options to "default". A monochrome image with a color consistency that was essentially the same as '18% gray' was created on the screen of the personal computer with the spreadsheet program named "Excel" produced by Microsoft, so that the monochrome image would be printed on the entire print area of the sheet. A copy of this monochrome image was printed as a halftone image in the monochrome mode. The homogeneity of the printed halftone image was checked by the eye. When the halftone image was homogeneous, without density irregularity, it was graded as Excellent, which is shown as "◎" in Table 1 below. When the halftone image had such a little density irregularity that it would not cause practical problems, it was graded as Fair, which is shown as "○" in the table. When the image had such considerable density irregularity that the image could not be acceptable from a practical viewpoint, it was graded as Failure, which is shown as "x" in the table. The results of the evaluation are shown in Table 1 in the column of "Evaluation of image Quality", or column E.

TABLE 1

| | A | B | C | D | E |
|---|---|---|---|---|---|
| Working Example 1 | 1 | 2.4 | 3 | ○ | ○ |
| Working Example 2 | 2 | 4.8 | 3 | ○ | ○ |
| Working Example 3 | 4 | 9.5 | 3 | ◎ | ◎ |
| Working Example 4 | 8 | 19.0 | 3 | ◎ | ◎ |
| Working Example 5 | 1 | 2.4 | 3 | ○ | ○ |
| Working Example 6 | 2 | 4.8 | 3 | ○ | ○ |
| Working Example 7 | 4 | 9.5 | 3 | ○ | ○ |

TABLE 1-continued

| | A | B | C | D | E |
|---|---|---|---|---|---|
| Working Example 8 | 8 | 19.0 | 3 | ○ | ○ |
| Comparative Example 1 | — | 0 | 3 | X | X |
| Comparative Example 2 | — | 0 | 6 | X | X |

Note:

In Table 1, "A" represents the ionic liquid content in parts by mass that was actually used in the examples; "B" the ionic liquid content in parts by mass to 100 parts by mass of the urethane-producing components; "C" the carbon black content in parts by mass; "D" the evaluation of fogging; and "E" the evaluation of image quality.

INDUSTRIAL APPLICABILITY

The electrically conductive roller according to the present invention is suitably used as electrically conductive rollers in the image-forming device of printers such as laser printers and video printers, copying machines, facsimile machines and all-in-one printers with the functions of these printers and machines. The electrically conductive roller of the present invention is especially appropriately employed for developing rollers and toner-supplying rollers which have to have a capability to carry a toner with a predetermined quantity of electric charge on the surface thereof in a uniform thickness and supply the toner to an image carrier.

EXPLANATION OF REFERENCE NUMERALS

1 electrically conductive roller
2 shaft
3 elastic layer
4 urethane coat layer
6 transfer and convey belt
10 image-forming device
11B, 11C, 11M, 11Y image carrier
12B, 12C, 12M, 12Y static charger
13B, 13C, 13M, 13Y exposing device
14B, 14C, 14M, 14Y transfer device
15B, 15C, 15M, 15Y cleaner
16 recording material
20 developing device
21B, 21C, 21M, 21Y housing
22B, 22C, 22M, 22Y toner
23B, 23C, 23M, 23Y toner carrier
24B, 24C, 24M, 24Y toner-amount adjuster
30 fixing device
31 fixing roller
32 pressure roller
33 endless belt-supporting roller
35 opening
36 endless belt
41 cassette
42 supporting roller
B, C, M, Y developing unit

We claim:

1. An electrically conductive roller comprising an elastic layer formed on an outer circumferential surface of a shaft and a urethane coat layer formed on an outer circumferential surface of the elastic layer, wherein the urethane coat layer includes a urethane resin, and at least one ionic liquid selected from the group consisting of pyridinium ionic liquids and amine ionic liquids, in an amount from 1 to 20 parts by mass to 100 parts by mass of the urethane resin, wherein the amine ionic liquids comprise ammonium ions each of which is formed from an alicyclic amine compound or an aliphatic amine compound.

2. The electrically conductive roller according to claim 1, wherein the at least one ionic liquid is selected from the group consisting of the pyridinium ionic liquids.

3. An image-forming device equipped with the electrically conductive roller according to claim 2.

4. An electrically conductive roller according to claim 2, wherein the pyridinium ion liquids include pyridinium cations each of which is formed from a pyridine ring whose nitrogen atom is bonded with an alkyl group.

5. The electrically conductive roller according to claim 4, wherein the alkyl group is a straight-chain alkyl group that has 1 to 18 carbon atoms optionally with substituents, a branched-chain alkyl group, or a cyclic alkyl group.

6. The electrically conductive roller according to claim 5, wherein the alkyl group is selected from the group consisting of methyl, ethyl, propyl, isopropyl, butyl, isobutyl, sec-butyl, tert-butyl, pentyl, neopentyl, hexyl, isohexyl, decyl, dodecyl, octadecyl, cyclopentyl, and cyclohexyl.

7. The electrically conductive roller according to claim 4, wherein the pyridine ring is an alkyl-substituted pyridine ring wherein at least one of the hydrogen atoms bonded to the carbon atoms that form the ring is replaced with an alkyl group.

8. The electrically conductive roller according to claim 7, wherein the alkyl group is a straight-chain alkyl group that has 1 to 18 carbon atoms optionally with substituents, a branched-chain alkyl group, or a cyclic alkyl group.

9. The electrically conductive roller according to claim 7, wherein the alkyl-substituted pyridine ring comprises a pyridine selected from the group consisting of α-picoline, β-picoline, γ-picoline, α-ethylpyridine, β-ethylpyridine, γ-ethylpyridine, 2,3-lutidine, 2,4-lutidine, 2,6-lutidine and 3,4-lutidine.

10. The electrically conductive roller according to claim 4, wherein the pyridinium ion liquids include anions selected from the group consisting of $BF_4^-$, $PF_6^-$, $CF_3SO_3^-$, and $(CF_3SO_2)_2N^-$.

11. The electrically conductive roller according to claim 10, wherein the pyridinium ion liquids are selected from the group consisting of N-propylpyridinium bis(trifluoromethanesulfonyl) imide, N-butylpyridinium bis(trifluoromethanesulfonyl)imide, N-pentylpyridinium bis(trifluoromethanesulfonyl)imide, N-hexylpyridinium bis (trifluoromethanesulfonyl)imide, N-heptylpyridinium bis (trifluoromethanesulfonyl)imide, N-octylpyridinium bis (trifluoromethanesulfonyl)imide, N-nonylpyridinium bis (trifluoromethanesulfonyl)imide, N-decylpyridinium bis (trifluoromethanesulfonyl)imide, and N-allylpyridinium bis (trifluoromethanesulfonyl)imide.

12. The electrically conductive roller according to claim 10, wherein the pyridinium ion liquids are N-hexylpyridinium bis (trifluoromethanesulfonyl)imide.

13. An image-formed device equipped with the electrically conductive roller according to claim 1.

14. The electrically conductive roller according to claim 1, wherein the ammonium ions comprise $R^1{}_4N_+$ ions, wherein four $R^1$'s may be the same or different from each other, each of $R^1$'s denotes a straight-chain, a branched-chain or cyclic alkyl group with 1 to 18 carbon atoms, and more than one of $R_1$'s may form at least one ring.

15. The electrically conductive roller according to claim 14, wherein the amine ionic liquids comprising $R^1{}_4N^+$ions, in which three of the four $R^1$'s are a same alkyl group, are selected from the group consisting of N,N,N-trimethyl-N-propylammonium bis(trifluoromethanesulfonyl)imide, N,N,N-trimethyl-N-butyl-ammonium bis(trifluoromethanesulfonyl)imide, N,N,N-trimethyl-N-pentylammonium bis (trifluoromethanesulfonyl)imide, N,N,N-trimethyl-N-hexylammonium bis(trifluoromethanesulfonyl)imide, N,N,N-trimethyl-N-heptylammonium bis(trifluoromethanesulfonyl)imide, N,N,N-trimethyl-N-octylammonium bis(trifluoromethanesulfonyl)imide, N,N,N-trimethyl-N-nonylammonium bis(trifluoromethanesulfonyl)imide, and N,N,N-trimethyl-N-decylammonium bis(trifluoromethanesulfonyl)imide.

* * * * *

UNITED STATES PATENT AND TRADEMARK OFFICE

CERTIFICATE OF CORRECTION

PATENT NO. : 8,968,168 B2
APPLICATION NO. : 13/388398
DATED : March 3, 2015
INVENTOR(S) : Tomoharu Takeuchi et al.

It is certified that error appears in the above-identified patent and that said Letters Patent is hereby corrected as shown below:

In the Claims

Column 20, Line 6, Claim 4, delete "An" and insert -- The --

Column 20, Line 32, Claim 9, delete "lutidine" and insert -- lutidine, --

Column 20, Line 53, Claim 13, delete "formed" and insert -- forming --

Column 20, Line 56, Claim 14, delete "$R^1{}_4N_+$" and insert -- $R^1{}_4N^+$ --

Column 20, Line 58, Claim 14, after "chain," delete "a"

Column 20, Line 60, Claim 14, delete "$R_1$'s" and insert -- $R^1$'s --

Column 20, Line 62, Claim 15, delete "$R^1{}_4N^+$ions," and insert -- $R^1{}_4N^+$ ions, --

Signed and Sealed this
Twenty-ninth Day of September, 2015

Michelle K. Lee

Michelle K. Lee
*Director of the United States Patent and Trademark Office*